US007726228B2

(12) United States Patent
York

(10) Patent No.: US 7,726,228 B2
(45) Date of Patent: Jun. 1, 2010

(54) UNIVERSAL CLAMP-ON MUZZLE DEVICE FOR MULTIPLE SIZE FIREARM BARRELS

(76) Inventor: Jack Martin York, P.O. Box 5625, McAllen, TX (US) 78504

( * ) Notice: Subject to any disclaimer, the term of this patent is extended or adjusted under 35 U.S.C. 154(b) by 0 days.

(21) Appl. No.: 12/156,389

(22) Filed: Jun. 2, 2008

(65) Prior Publication Data

US 2009/0293708 A1 Dec. 3, 2009

(51) Int. Cl.
*F41A 21/36* (2006.01)

(52) U.S. Cl. ..... 89/14.3; 89/14.2; D22/108

(58) Field of Classification Search ..... 89/14.2, 89/14.3, 14.4, 14.5; D22/108, 109
See application file for complete search history.

(56) References Cited

U.S. PATENT DOCUMENTS

| | | | | |
|---|---|---|---|---|
| 1,390,568 | A | 9/1921 | Towson | |
| 2,073,755 | A | 3/1937 | Poate | |
| 2,448,593 | A * | 9/1948 | Heising | 89/14.2 |
| 2,852,983 | A | 9/1958 | Netzer | |
| 3,191,330 | A | 6/1965 | Olson | |
| 3,886,667 | A * | 6/1975 | Rueb | 42/141 |
| 4,429,614 | A * | 2/1984 | Tocco | 89/14.3 |
| 4,436,017 | A | 3/1984 | Mohlin | |
| D384,389 | S * | 9/1997 | Cyktich | D22/108 |
| D449,668 | S | 10/2001 | Gangl, Jr. | |
| 6,820,530 | B2 | 11/2004 | Vais | |
| 7,032,339 | B1 | 4/2006 | Bounds | |
| 7,143,680 | B2 * | 12/2006 | Bender | 89/14.3 |
| 7,451,564 | B2 * | 11/2008 | Wait | 42/75.02 |
| 2004/0244571 | A1 * | 12/2004 | Bender | 89/14.3 |
| 2007/0095198 | A1 * | 5/2007 | Dater et al. | 89/14.2 |
| 2007/0186458 | A1 * | 8/2007 | Wait | 42/75.02 |

OTHER PUBLICATIONS www.brownells.com—"Adjustable Muzzle Brake".

* cited by examiner

*Primary Examiner*—Benjamin P Lee

(57) ABSTRACT

A bolt-on muzzle brake having an angled base (5), clamps (2) to secure it to a firearm barrel (12), and a tube (6) at the end of the angled base (5) that redirects the recoil producing gases. The muzzle brake can be attached to a barrel without threading it on the barrel. The muzzle brake can also be attached to multiple sized barrels, different caliber barrels, and barrels with front sights all with the same muzzle brake.

1 Claim, 4 Drawing Sheets

UNIVERSAL CLAMP-ON MUZZLE DEVICE FOR MULTIPLE SIZE FIREARM BARRELS

BACKGROUND

1. Field of Invention

This invention relates to muzzle brake devices used on firearms to reduce felt recoil to the shooter.

2. Prior Art

A muzzle brake also called by other names i.e. compensator, recoil reducer is designed to vent and/or redirect recoil producing gases upon the discharge of a firearm to reduce felt recoil to the shooter. Since the muzzle brake receives and redirects the expelling gases from the barrel it must be firmly attached to the barrel. First, if the muzzle brake is not firmly attached the gas pressure at the end of the barrel can eject it from the barrel by shear force. Secondly, it the muzzle brake becomes loose from repeated firing it can also be ejected off the barrel with a bullet strike. For these reasons muzzle brakes are attached either by: (1) threading the barrel and the muzzle brake, (2) the barrel is designed/grooved for accepting a particular muzzle brake i.e. military rifle, (3) the barrel diameter and muzzle brake diameter are equal and thus a perfect fit and secured like a barrel band with set screws. However none of the disclosed patents allow for one single muzzle brake to be used on firearms without threaded barrels, barrels with a front sight, or different diameter barrels (meaning one single muzzle brake will fit on more than one size barrel). The following disclosed patents range from actual muzzle brakes to attachments for firearm accessories.

U.S. Pat. No. 7,032,339 by Bounds, U.S. Pat. No. 6,820,530 by Vais, U.S. Pat. No. 4,436,017 by Mohlin, and U.S. Pat. No. 2,852,983 by Netzer, all illustrate a screw-on type muzzle brake onto a similarly threaded barrel. These inventions met the requirement of rigid attachment to the barrel however one major drawback is that all require a barrel to be threaded. The firearm is permanently altered and if the front sight is too close to the front of the barrel it will need to be removed before the barrel can be threaded. Altering the barrel by threading it alters the value of the firearm. The second drawback is the cost for threading the barrel. Also Mohlin uses a wear ring in the front of the muzzle brake that can be replaced when it becomes worn but is not designed to be used for different calibers or different positions of the projectile passing through the exit hole due to multiple barrel sizes.

U.S. Pat. No. D449,668 by Gangl illustrates a slide-on type muzzle brake. For this design to work the inner portion that houses the barrel must be the same diameter as the barrel for a snug fit. Due to this design one muzzle brake cannot be used on multiple firearms because different firearms have different barrel diameters. Another drawback of this design is that the expelled gases are partially redirected and there is no forward pull of the firearm by gases hitting the end of the muzzle brake. The brake is strictly flow through.

U.S. Pat. No. 3,191,330 by Olson illustrates a bolt-on type firearm accessory attached to the barrel of a firearm. The design however is for a vibration damper. The side clamp as designed could not withstand the force of muzzle blast if it were used to attach a muzzle brake.

U.S. Pat. No. 2,073,755 by Poate illustrates a bolt-on type firearm accessory attached to the barrel of a firearm. The design however is for an attachment to a tripod or carriage. The side clamp is semi-cylindrical on each inside portion of the clamp and because of this shape the clamp is then restricted to one barrel size only.

U.S. Pat. No. 1,390,658 by Towson illustrates a slide-on type muzzle brake. The design allows for the muzzle brake to slide onto the barrel and hook the front sight which holds the device onto the barrel. The drawback is that the muzzle brake must fit the barrel with close tolerance including the front sight. In other words the device must be designed specifically for each barrel with a front sight for diameter and front sight location and size. Secondly on barrels without a front sight this design will not work.

One muzzle brake on the market (www.brownells.com—"adjustable muzzle brake") is a slip-on type but it cannot be used on firearms that have a front sight within 1" of the muzzle. Also each muzzle brake will fit only one barrel size meaning that over 20 different sizes are built to fit a group of firearms.

DRAWINGS

Figures

Figure 1:
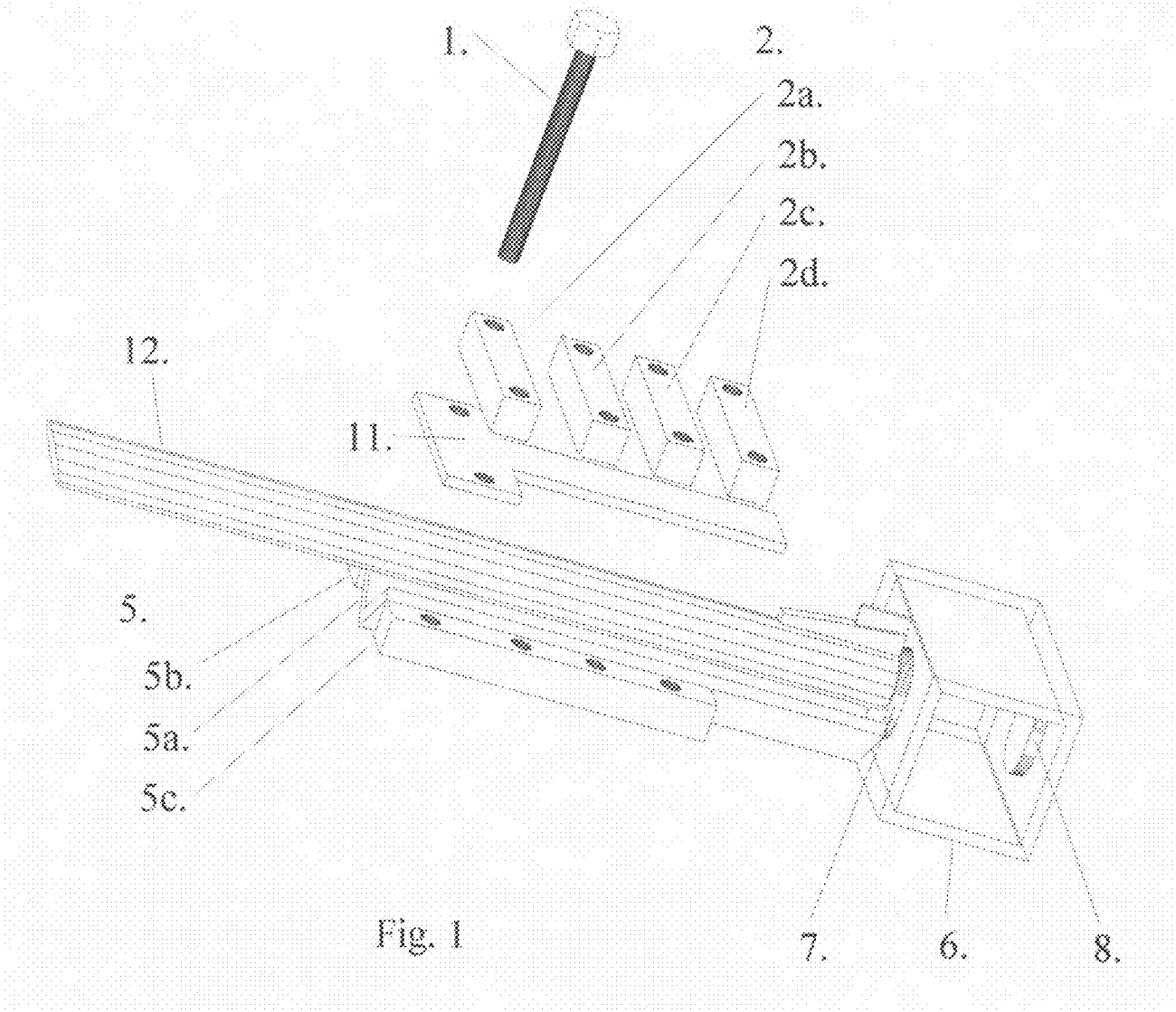
FIG. 1 shows a side orthographic view of the device.

| DRAWINGS - Reference Numerals | |
|---|---|
| 1 | bolt |
| 2 | upper clamp assembly |
| 2a | upper clamp |
| 2b | upper clamp |
| 2c | upper clamp |
| 2d | upper clamp |
| 5 | lower clamp assembly |
| 5a | base |
| 5b | bolt receptor |
| 5c | bolt receptor |
| 6 | muzzle brake tube |
| 7 | muzzle brake tube entry aperture |
| 8 | muzzle brake tube exit aperture |
| 9 | muzzle brake tube orifice |
| 10 | orifice bolt |
| 11 | cushion plate |
| 12 | firearm barrel |

DETAILED DESCRIPTION

Figure 2:
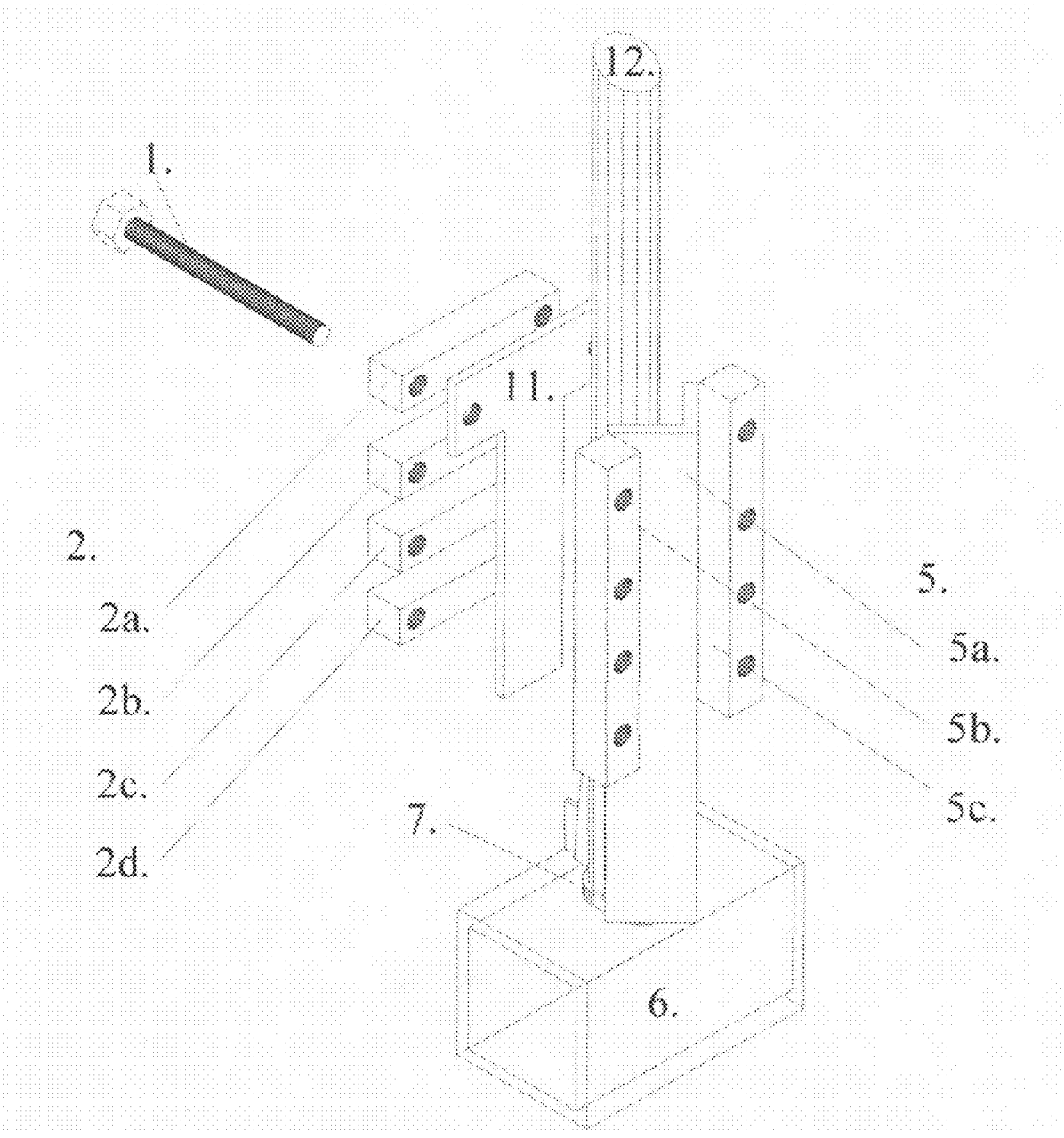
FIG. 2 shows an upright orthographic view of the device.
Figure 3:
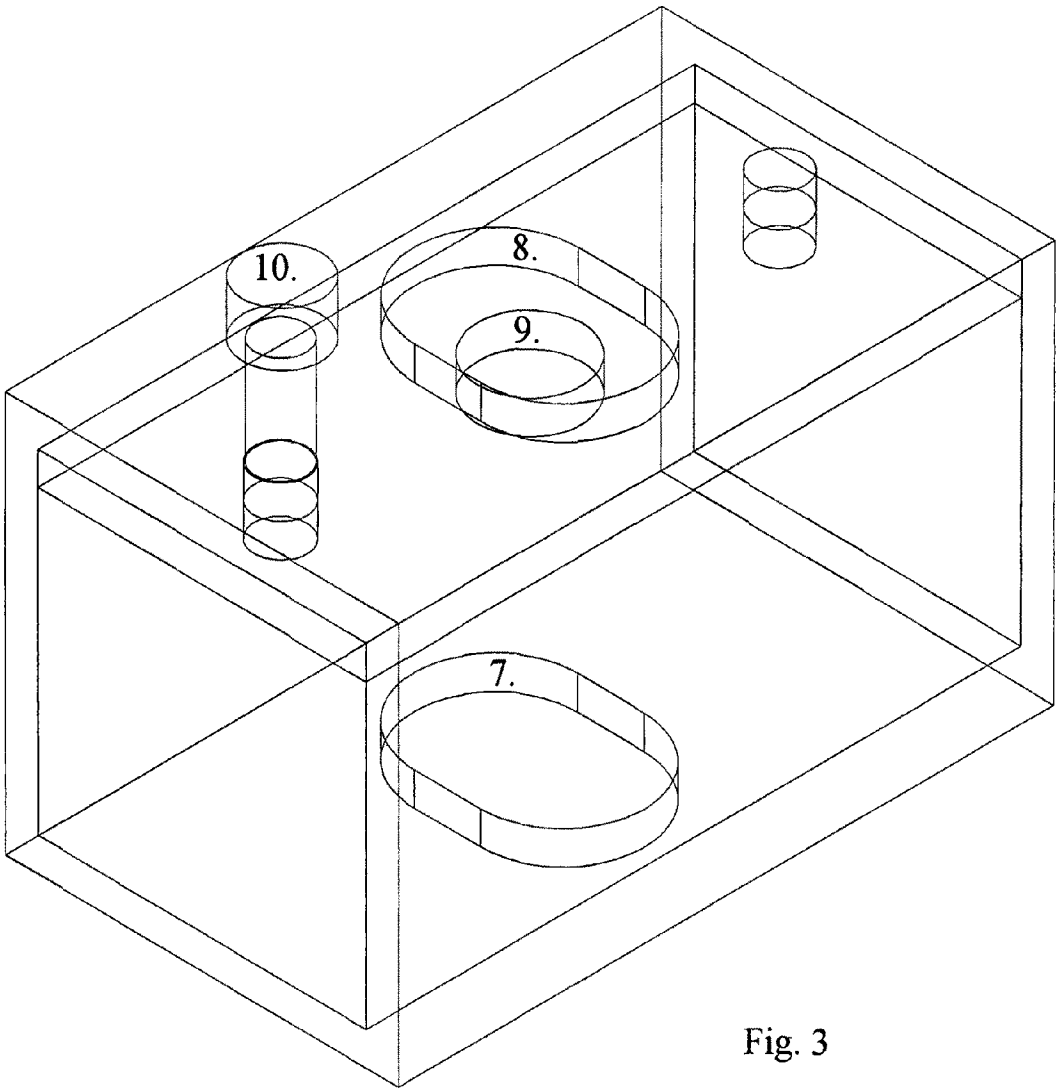
FIG. 3 shows an orthographic view of the muzzle brake end of the device with a detachable orifice as another embodiment.
Figure 4:
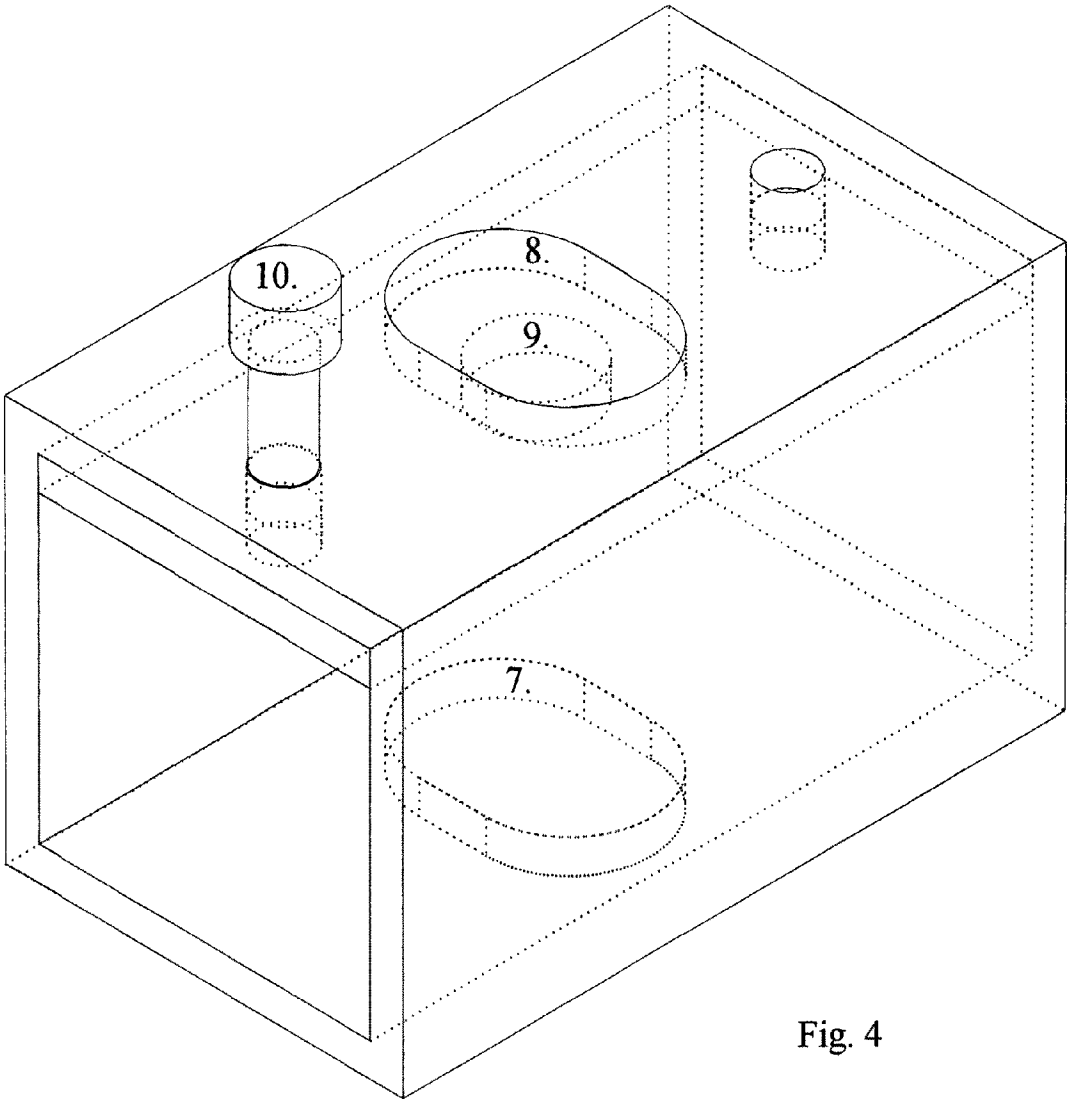
FIG. 4 shows an orthographic view with hidden lines of FIG. 3.

FIG. 1-3—Preferred Embodiment

One embodiment of the device is illustrated in FIG. 1 (side orthographic view), and FIG. 2 (upright orthographic view). The device has a muzzle brake tube 6 which is open on both ends comprised of a rigid material like steel, etc. and shown shaped as a square tube but the shape could also be rectangular or round. Approximately centered along the horizontal axis of tube 6 are two oblong shaped holes at opposite ends of each other and perpendicular to the open ends of tube 6. One of the two holes is the muzzle brake tube entry aperture 7 and the other hole is the muzzle brake tube exit aperture 8. The oblong shape of both aperture 7 and aperture 8 is oblong along the vertical axis in FIG. 1.

Rigidly attached to muzzle brake tube 6 at the point of muzzle brake tube entry aperture 7 is the lower clamp assembly 5 shown in FIGS. 1-2. Tube 6 is attached to assembly 5 such that muzzle brake tube entry aperture 7, aperture 8 and assembly 5 are aligned along the longitudinal axis of assembly 5. Assembly 5 can be a single milled piece or 3 separate pieces welded together consisting of a base 5*a* of rigid angled material such as steel, etc. and two bolt receptors 5*b* and 5*c* of rigid material such as steel, etc. parallel and rigidly attached. Both bolt receptors 5*b* and 5*c* have threaded holes. The base 5*a* can be an angled piece of equal thickness material as shown in FIGS. 1-2 or a milled piece of square or rectangular stock with the angle cut on the inside portion that will contact barrel 12. Base 5*a* is lined with a soft protective material such as rubber, etc. to serve as a barrier between base 5*a* and barrel 12.

Above barrel 12 in FIG. 1 is cushion plate 11 consists of a rigid material with a liner identical to the liner on base 5*a*. The length of plate 11 is commensurate with the clamping action of assembly 5 and the width is commensurate with the width of assembly 5 as shown if FIGS. 1-2.

Above cushion plate 11 in FIG. 1 is upper clamp assembly 2 consisting of a rigid material with unthreaded holes that line up with lower clamp assembly 5. Upper clamp assembly 2 is made of upper clamps 2*a*-2*d*. Assembly 2 can be made of one solid piece rather than a series of clamps. Through each hole in upper clamp assembly 2 a bolt 1 is threadable into lower clamp assembly 5.

Operation—FIGS. 1-2

The upper clamp assembly 2 and each corresponding bolt 1 are removed from lower clamp assembly 5 prior to assembly to a firearm. Be sure that base 5*a* and cushion plate 11 liners are intact and if not they should be replaced before continuing assembly.

As shown in FIG. 1 place barrel 12 into base 5*a* and slide it up to muzzle brake tube entry aperture 7. Next put cushion plate 11 with the liner facing barrel 12 and line up holes with the rear holes of assembly 5. Insert a bolt 1 through each hole in upper clamp assembly 2, through the two holes of cushion plate 11, and thread each bolt 1 into assembly 5.

Arrange barrel 12 so that it is horizontal with muzzle brake tube 6 before tightening each bolt 1 and after alignment is made then tighten bolt 1 in each clamp securely. Depending on the model of firearm barrel 12 may have a front sight that extends into the area of assembly 2 and this is not a problem but rather an aid in securing the device to barrel 12. Since assembly 2 is a series of upper clamps 2*a*-2*d* the difference in height of a front sight is independently accommodated with each clamp. The front sight will act as a wedge anchor for the muzzle brake once tightened.

The wedge shape of base 2*a* allows for perfect centering of firearm barrel 12 regardless of diameter. The shape of base 5*a* being "V" shaped is particularly important because the shape aligns the barrel along the longitudinal axis of the muzzle brake regardless of diameter or taper. The oblong shapes of muzzle brake tube entry aperture 7 and muzzle brake tube exit aperture 8 accommodate different caliber bullets and different size barrel 12 avoiding bullet strike. The oblong shape of aperture hole 8 and aperture hole 9 are particularly important because the shape allows easy projectile clearance with various barrel diameters and tapers. The oblong shape does let some gas escape through however most is caught on the inside wall of the device and in fact the larger the caliber bullet and the higher the pressure of the gas the more efficient the device operates. Before firing double check alignment by looking down the end of the barrel through the device to see that the bullet path will not hit muzzle brake tube 6.

The side exhaust ports on the muzzle brake tube 6 are sufficiently large to minimize any ambient noise or pressure caused by the device. The recoil reduction and forward pull of a firearm caused by the device during firing is efficient and has been tested on rifles up to and including a .458 Winchester Magnum with full power loads.

Additional Embodiment

FIGS. 3-4

FIG. 3 shows an additional embodiment of an isolated view of muzzle brake tube 6 with added components of a muzzle brake tube orifice 9 and orifice bolt 10. Orifice 9 has a more restrictive exit hole than the muzzle brake tube exit aperture 8 and two threaded holes that line up with two unthreaded holes in tube 6. Orifice 9 is composed of a less rigid material like aluminum of a size that fits inside of tube 6 and still makes a seal of aperture 8. Bolt 10 fits into each bolt hole in tube 6 and orifice 9 and is long enough to penetrate both components and does not extend into the open area of tube 6.

Operation of Additional Embodiment

The assembly of the device on barrel 12 is the same and the only difference is choosing the correct muzzle brake tube orifice 9 that matches barrel 12 size and caliber of the bullet. Orifice 9 opening as installed must be clear of the bullet path and is checked by looking down the end of the barrel through the device for proper alignment. Orifice bolt 10 is then tightened on both sides of orifice 9 until tight.

The reason for using orifice 9 is to further increase efficiency of the device. Orifice 9 is made of a less rigid material because in the event of a bullet strike due to incompetent installation no harm will occur to the shooter or the muzzle brake.

Advantages

From the description above a number of advantages are shown:

(a) The muzzle brake is bolted on the firearm for ease of installation (b) The materials used are common and little if any complicated machining needs to be done depending on method of manufacture.

(c) The large tube on the muzzle brake is efficient at reducing felt recoil.

(d) The muzzle brake will center the barrel along the longitudinal axis because of the "V" shape of the base where the barrel rests.

(e) The muzzle brake allows the projectile to pass through the tube aperture 7 and tube aperture 8 even in barrels of various diameters and tapers because the holes are oblong.

CONCLUSION, RAMIFICATIONS AND SCOPE

The reader will note that the device in its various embodiments does solve the problem of a universal and detachable muzzle brake that does not require alteration of the firearm to accommodate its use and can be used on barrels with different diameters and tapers. The muzzle brake is no less efficient than other muzzle brakes that must be threaded to the barrel or require some special adaptation on the firearm barrel to attach a muzzle brake. In addition the muzzle brake has additional advantages:

(a) Using the bolt-on method of attaching the device to the barrel forgoes the need and cost of threading the barrel of the firearm.

(b) Thread-on muzzle brakes require more precision because of barrel size matching with the thread-on muzzle brake but no expertise is required to install the bolt-on muzzle brake.

(c) Firearm owners are generally uneasy about altering the barrel to accommodate a thread-on muzzle brake so the simple bolt-on type muzzle brake is preferable.

(d) Slip-on type muzzle brakes have the same problem of matching barrel size and cannot be used on different firearms whereby the bolt-on muzzle brake does not have this limitation.

(e) Slip-on types cannot be used when the front sight is close to the end of the barrel however, the bolt-on muzzle brake does not have this limitation.

Thus none of the prior art can be considered a multiple barrel, multiple caliber muzzle brake allowing use on a wide range of firearms from a single muzzle brake. Although the description above contains many specificities these should not be considered as limiting the scope of the embodiment but merely as illustrations of the some of the currently preferred embodiments. For example the muzzle brake tube can be rectangular, square, or round; the base of lower clamp assembly can be milled from square stock by simple cutting the notch and drilling the holes, etc.

Thus the scope of the embodiment should be determined by the appended claims or equivalent rather than the above examples.

What is claimed is:

1. A clamp on muzzle brake for a plurality of firearm barrels with different diameters or tapers to provide a reduction in recoil forces and accommodate a plurality of different projectile paths, said muzzle brake comprising:

A V-shaped base for cradling the bottom of any of said plurality of barrels along a longitudinal axis of said V-shaped base near a muzzle end of said barrel;

A clamp portion for contacting the top of the barrel and attaching to the V-shaped base to secure the barrel therebetween such that said longitudinal axis of said V-shaped base is substantially parallel to a longitudinal axis of said barrel when clamped;

a muzzle brake tube attached to the end of said V-shaped base, said muzzle brake tube comprising a plurality of oblong holes with a long and short axis;

Wherein the long axis is parallel to a plane extending from the apex of the V of the V-shaped base thru the centerline of the barrel such that the holes will provide sufficient clearance for bullets exiting from any of said barrels having different diameters;

Wherein the long and short axes of said oblong holes are substantially perpendicular to said longitudinal axis of said V-shaped base such that a corresponding projectile exiting the muzzle end of a clamped one of said barrels is capable of entering and exiting said muzzle brake tube without contacting said tube.

* * * * *